US007775996B2

(12) United States Patent
Strømsnes

(10) Patent No.: US 7,775,996 B2
(45) Date of Patent: Aug. 17, 2010

(54) CHEST COMPRESSION SYSTEM

(75) Inventor: Øystein Strømsnes, Tau (NO)

(73) Assignee: Laerdal Medical AS, Stavanger (NO)

( * ) Notice: Subject to any disclaimer, the term of this patent is extended or adjusted under 35 U.S.C. 154(b) by 946 days.

(21) Appl. No.: 11/584,243

(22) Filed: Oct. 20, 2006

(65) Prior Publication Data

US 2008/0097257 A1 Apr. 24, 2008

(51) Int. Cl.
*A61H 31/00* (2006.01)

(52) U.S. Cl. ..... 601/41; 601/44

(58) Field of Classification Search ..... 601/41, 601/42, 43, 44, 84, 107, 108, 151, 152; 607/5, 607/6

See application file for complete search history.

(56) References Cited

U.S. PATENT DOCUMENTS

| | | | | |
|---|---|---|---|---|
| 3,425,409 | A | 2/1969 | Isaacson | |
| 3,489,140 | A | 1/1970 | Mullikin | |
| 3,782,371 | A | 1/1974 | Derouineau | |
| 4,237,872 | A | 12/1980 | Harrigan | |
| 4,273,114 | A | 6/1981 | Barkalow et al. | |
| 4,632,094 | A | 12/1986 | Thomas | |
| 5,327,887 | A | 7/1994 | Nowakowski | |
| 5,490,820 | A | 2/1996 | Schock et al. | |
| 5,496,257 | A | 3/1996 | Kelly | |
| 5,571,142 | A | 11/1996 | Brown et al. | |
| 5,743,864 | A | 4/1998 | Baldwin, II | 601/41 |
| 5,823,185 | A | 10/1998 | Chang | |
| 5,833,711 | A | 11/1998 | Schneider, Sr. | |
| 6,090,056 | A | 7/2000 | Bystrom | |
| 6,171,267 | B1 | 1/2001 | Baldwin, II | 601/106 |
| 6,224,562 | B1 | 5/2001 | Lurie et al. | |
| 6,312,399 | B1 | 11/2001 | Lurie et al. | |
| 6,398,745 | B1 | 6/2002 | Sherman et al. | 601/41 |
| 6,807,442 | B1 | 10/2004 | Myklebust et al. | |
| 6,827,695 | B2 * | 12/2004 | Palazzolo et al. | 601/41 |
| 7,226,427 | B2 | 6/2007 | Steen | |
| 7,569,021 | B2 | 8/2009 | Sebelius et al. | |
| 2002/0165471 | A1 | 11/2002 | Halperin et al. | |
| 2003/0181834 | A1 | 9/2003 | Sebelius et al. | 601/41 |
| 2004/0002667 | A1 | 1/2004 | Sherman et al. | 601/44 |
| 2004/0039313 | A1 | 2/2004 | Sherman et al. | |
| 2004/0162587 | A1 | 8/2004 | Hampton et al. | 607/5 |
| 2004/0230140 | A1 | 11/2004 | Steen | 601/41 |

(Continued)

FOREIGN PATENT DOCUMENTS

| | | |
|---|---|---|
| GB | 527048 | 10/1940 |

(Continued)

OTHER PUBLICATIONS

Hansen, Federik , "Office Action for U.S. Appl. No. 11/584,256", Feb. 17, 2010.

(Continued)

*Primary Examiner*—Quang D Thanh
(74) *Attorney, Agent, or Firm*—Dorsey & Whitney LLP

(57) ABSTRACT

The invention regards a resuscitation system which having a chest compression device to repeatedly compress the chest of a patient and thereafter cause or allow the chest to expand. A signal processor is connected to the chest compression device to control the operation of the chest compression devices. A power supply device provides electrical power to the chest compression device and the signal processor.

12 Claims, 3 Drawing Sheets

U.S. PATENT DOCUMENTS

| | | | | |
|---|---|---|---|---|
| 2005/0137628 | A1 | 6/2005 | Young et al. | |
| 2006/0084892 | A1* | 4/2006 | Lenhart et al. | 601/41 |
| 2006/0089574 | A1 | 4/2006 | Paradis | 601/41 |
| 2006/0155222 | A1 | 7/2006 | Sherman et al. | |
| 2008/0097261 | A1 | 4/2008 | Hansen et al. | 601/107 |
| 2008/0097534 | A1 | 4/2008 | Myklebust et al. | |

FOREIGN PATENT DOCUMENTS

| | | |
|---|---|---|
| WO | WO-9959673 | 11/1999 |
| WO | WO-2004073580 | 9/2004 |
| WO | WO-2006088373 | 8/2006 |

OTHER PUBLICATIONS

Myklebust, Helge , "Office Action for U.S. Appl. No. 11/584,257", May 11, 2009.

Myklebust, Helge , "Office Action for U.S. Appl. No. 11/584,257", Nov. 24, 2009.

Strømsnes, Øystein , "Office Action for U.S. Appl. No. 11/584,243", Sep. 25, 2009.

Vessela, Krasteva et al., "Assessment of ECG Frequency and Morphology Parameters for Automatic Classification of Life-Threatening Cardiac Arrhythmias", *Institute of Physics Publishing. Meas. 26*, 2005 , 707-723.

* cited by examiner

CHEST COMPRESSION SYSTEM

TECHNICAL FIELD

This invention is related to resuscitation systems, and, more particularly, to a resuscitation system that alternately compresses the chest of a patient and then allows or causes the patient's chest to expand.

BACKGROUND OF THE INVENTION

Sudden cardiac arrest is a leading cause of death in developed countries in the Western World, like United States and Canada. To increase the chance for survival from cardiac arrest, Cardio Pulmonary Resuscitation ("CPR") and heart defibrillation should be given in the first few critical minutes after the incident. CPR is performed to ensure a sufficient flow of oxygenated blood to vital organs by external compression of the chest combined with rescue breathing. Heart defibrillation is performed to re-establish normal heart rhythm by delivery of an external electric shock.

The quality of CPR is an important factor in survival rate. To maximize the chances for survival, chest compressions must be given with a minimum of interruptions, and be of sufficient depth and rate. Performing chest compressions manually is an extremely exhausting task, and it is practically impossible to give manual CPR of sufficient quality during transportation of a patient. To overcome this problem, a number of automatic and manual mechanical external chest compression devices for cardiopulmonary resuscitation have been developed. For example, a device available from Michigan Instruments provides for automatic mechanical external chest compressions using a vertical column attached to a base plate. Compressed gas (oxygen or air) drives the device, and the device may include a ventilator for ventilating the patient. This device is described in U.S. Pat. Nos. 6,171,267 and 5,743,864. A cantilevered arm with a cylinder and piston assembly slides up and down on a column to compress the chest of a patient. The system comprises a measuring device to measure the depth of the patient's chest (thorax) compressions. The depth may be compared to a table in order to adjust the compression depth to each patient. This leads to delay in start-up of the compressions, and the procedure does not compensate for possible chest collapse during therapy.

U.S. Patent Publication No. 2003181834 describes another chest compression apparatus. The device comprises a back plate positioned behind the patient's back posterior to the patient's heart. The device also includes a front part for positioning around the patient's chest anterior to the patient's heart. The front part comprises two legs, which can be coupled to the back plate. The front part comprises a compression unit that automatically compresses or decompresses (lifts) the patient's chest. The width and compression depth of the apparatus is fixed and cannot be adapted to each patient. This device is gas driven, which means that it is large and heavy to use due to the need for a supply of compressed gas. Compressed oxygen may substitute for compressed air, for example, if the supply of compressed air becomes depleted, but this substitution may lead to an increased risk of fire.

U.S. Pat. No. 6,398,745 shows another example of an automatic CPR-device. This device uses a compression belt extending around the chest of a patient. The belt is repetitively tightened and relaxed through the action of a belt-tightening spool powered by an electric motor. The motor is controlled by a control system that times the compressions and controls the compressions through an assembly of clutches and brakes connecting the motor to the belt-tightening spool. The compression belt compresses and decompresses the chest of a patient, but it can easily get caught in the patient's clothes. For this reason the patient must be unclothed before the chest compression procedure can start, and valuable time is lost. The belt also covers a large area of the patient's chest and can thus interfere with defibrillation electrodes. Further, use of this deice requires that either the defibrillator electrodes be arranged on the patient prior to the arrangement of the belt or that the belt be removed before defibrillation can take place. The belt also makes use of a stethoscope to check for correct intubation and adequate rise cumbersome.

The above-mentioned devices have limitations in use, and even though automatic mechanical CPR is well documented to deliver adequate circulation to the brain and heart during CPR, such systems have not been widely used by medical personnel. The reasons for this are, among others, that they either are complicated and time-consuming to apply, cumbersome to install and operate, and/or are unstable on the chest. They are further heavy and expensive to purchase. There is therefore a need for a resuscitation device that is easy to use, rugged, portable and light weight, safe and reliable, has an intuitive user interface, ensures patient stability and has an affordable price.

SUMMARY OF THE INVENTION

A resuscitation system according to the present invention comprises a chest compression device to repeatedly compress the chest of a patient and then cause or allow the chest to expand. A signal processor is connected to the chest compression device to control the operation of the chest compression device, and a power supply device provides electrical power to the chest compression device and the signal processor. The chest compression device may be any device suitable for compressing the chest of a patient, such as pneumatic, hydraulic, or electric actuated pistons, belts, straps, etc. The chest compression device may be fixed to the patient's chest/skin by means of fastening devices, such as tape or by vacuum, or it can be merely in contact with the chest without being fastened to the chest. The chest compression device can be designed to cause the chest to expand, i.e. is to perform an active lifting of the chest, or to allow the chest to expand freely.

The chest compression device is preferably connected to a support in order to maintain the position of the chest compression device on the patient's chest substantially constant. A substantially constant positioning of the chest compression device on the patient's chest is important in order to obtain the necessary quality of the compressions and for safety reasons. The support may be adapted to be arranged under the patient, on one of the sides, or reaching round the patient. The support may comprise two legs connected to a back plate and to a transverse plate. The back plate is adapted for placement under the patient when the patient is lying, and the two legs are adapted for placement on both sides of the patient. The width and the height of the quadrangle may be adjusted to fit each patient.

DETAILED DESCRIPTION

Figure 1:
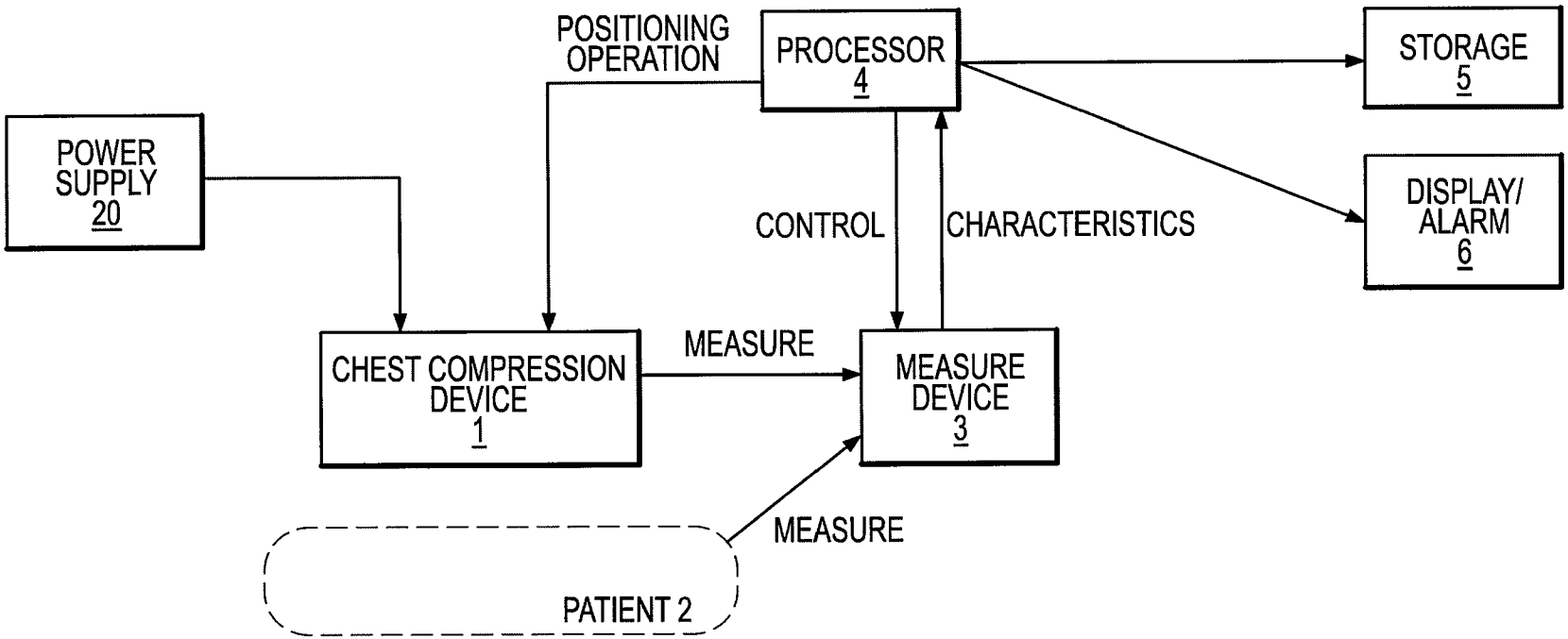
FIG. 1 is a block diagram of an embodiment of the invention.

FIG. 1 is a block diagram of an embodiment of the resuscitation system according to the invention. This block diagram shows a chest compression device 1 for repeatedly compressing the chest of a patient 2 to cause or allow the chest to expand. The device also includes a measuring device 3 for measuring characteristics of the resuscitation process. The measuring device 3 may be implemented using any sensors or other measuring devices suitable for measuring characteristics of the resuscitation process, and/or other relevant information regarding CPR in the system and/or in the patient. Such sensors/measuring devices may be, for example, force sensors and/or depth sensors for measuring force/depth exerted/traveled by the compression device, compression counters, compression frequency counters, blood flow sensors for monitoring the blood flow of the patient, ventilation sensors for monitoring the ventilation flow, volume, and/or time interval of patient ventilation, impedance measuring means for measuring the impedance of the chest and thus give an indication of the ventilation of the patient, an electrocardiogram (ECG) device, tilt sensors for measuring the angle of the patient (whether the patient is lying, sitting/standing), position detectors for detecting the positioning and/or change of positioning of the chest compression device 1, battery power measurement means, internal motor temperature measuring means, etc. The results from the measuring devices may be used to provide information to the users and/or as feedback to the processor for adjusting/changing the control signals to the chest compression device 1.

The chest compression device 1 and measuring device 3 receive electrical power from a power supply 20, and the chest compression device 1 is controlled by a signal processor 4 connected to the measuring device 3 and/or the chest compression devices 1. In this embodiment of the invention, the signal processor 4 is connected to a data-storing device 5 to permit storage of measurement values and thus provide historical data. These stored values may later be used for evaluating the resuscitation episode. In this way systematic or occasional operator errors may also be revealed and this knowledge may be used to adjust procedures and/or train personnel. Stored values may also be used to reveal equipment errors and initiate service. The signal processor 4 is also connected to a display device 6 to display characteristics of the resuscitation process, and/or alarms.

Figure 2:
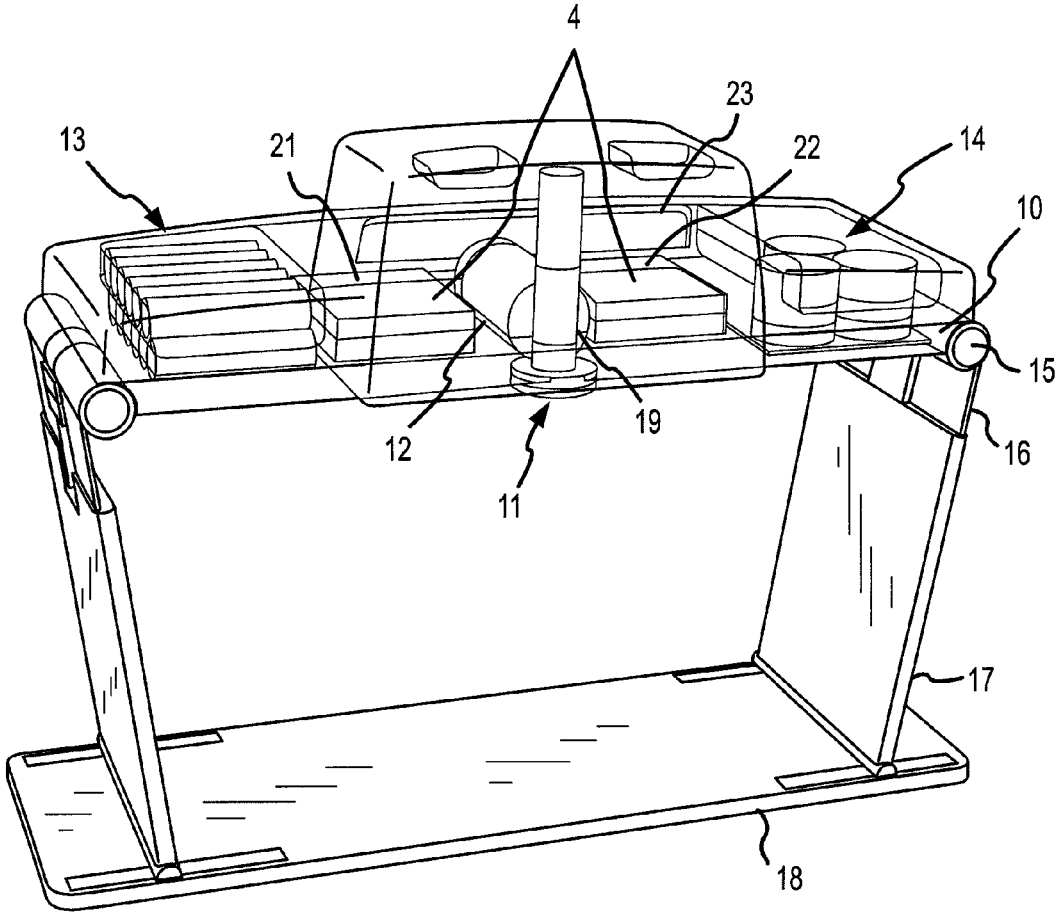
FIG. 2 is an isometric view of an embodiment of the invention.

FIG. 2 is an isometric view of an embodiment of the invention. In this embodiment of the invention, the chest compression device 1, the signal processor 4 and the power supply 20 are mounted on a transverse plate 10.

The chest compression device 1 used in the embodiment of FIG. 2 include a piston 11, a motor 12, and a transmission mechanism 19 for transmitting energy from the motor 12 to the piston 11. The motor 12 receives power from power supply, which may be composed of batteries 13, for example Lithium-ion chemistry type batteries, and boost electronics 14. The power supply may alternatively be a device for connection to power sources in an ambulance, in a hospital, or in an external power storage device such as a battery or capacitor, or any other available power supply device. Power adapters/converters may also be used to convert power from the power supplies to different characteristics/properties such as different voltage, frequency, etc.

The piston 11 is driven by the motor 12 to reciprocate up and down to alternately compress and allow decompression of the patient's chest. The boost electronics provides a high energy, short pulse to the power input of the motor 12.

The signal processor 4 controls operation of the chest compression device based on predetermined characteristics and/or on characteristics measured by measuring devices, such as the measuring device 3. These characteristics can be any of the above-described characteristics that can be measured by the measuring device 3. The control signals may for example be based on patient characteristics, such as a measured chest height/depth of the patient, age of the patient, ECG measurements, etc. In this way the resuscitation system may use a pulse pattern particularly adapted to the specific patient. Control signals provided by the signal processor 4 to control the actuation of the chest compression device 1 may be signals for controlling the 12, such as start/stop signals and/or signals controlling e.g. depth/force/frequency of the compressions.

The resuscitation system may also comprise ventilation devices 21. The ventilation devices may be regular ventilation devices, which may be operated by an operator, or they may be autonomous/automatic ventilation devices. If the ventilation devices are operated by an operator, the resuscitation system may include a sensor for measuring characteristics (quality) of the ventilation, such as ventilation rate and volume. The resuscitation system may also comprise feedback devices, such as speaker or display, to give feedback to the operator on the performed ventilations, position stability of the chest compression device, time left of battery, stiffness changes in the patient's chest, or other aspects regarding the ventilation system or the patient.

The resuscitation system may also comprise a defibrillator device 22 in order to defibrillate the patient. The defibrillator device may be manual or automatic (AED). The defibrillator devices may include ECG measuring devices. The defibrillator device may include a separate or integrated processor that can calculate the optimal point in time to operate the defibrillator device and the optimal characteristics of the defibrillation and start the defibrillator or give an indication on correct start time based on these values.

The transverse plate 10 on which the above-described components are mounted is substantially rectangular, and it is connected on its short edges to two lateral legs each of which includes an upper part 16 and a lower part 17. A connection between transverse plate 10 and the upper part 16 of each of the legs is implemented by hinges 15. The hinges 15 permit the legs to rotate downwardly towards the transverse plate to provide a storage position for the resuscitation system. The upper part 16 can also telescope inside the lower part 17 to permits easy variation of the lengths of the legs.

When the resuscitation system according to the invention is being used, the legs are placed on the sides of a patient's body. The lower edge of each of the lower parts 17 is connected to a back plate 18 that is adapted for placement under the patient's back. The lower parts 17 of the legs can be fixed, shiftable, or rotatably connected to the back plate 18. In one embodiment of the invention, they are laterally shiftable in order to be able to be arranged in contact with the patient's body, and when in correct position they are fixedly connected to the back plate 18. In use, the chest compression device 1 is connected to the transverse plate 10 in such a way that the direction of the compression movement of the chest compression device 1 is substantially perpendicular to thorax in the area between the nipples. This may for example mean that the movement of the chest compression device 1 is substantially perpendicular to a plane comprising sternum, and substantially parallel to the back plate 18. The resuscitation system may be positioned relative to the patient's length by means of illustrations on the support or by other display devices that will be visible to an operator. In one embodiment the system may comprise physical devices or arrangements that indicate and/or guide the positioning of the system relative to the patient, for example, by arranging the legs so that they are placed in the patient's armpits, or by a rod indicating the distance to the patient's shoulders, etc.

The chest compression device 1 used in the embodiment of FIG. 2 may further comprise a user interface 23 for providing information regarding the resuscitation. The user interface may provide information related to the service level of the system, remaining power, defibrillator status, ventilation status or other information which would be useful for the operator during or after the resuscitation.

During transport and storage, the legs may be separated from the back plate 18 thereby providing two separate sections, one section including the legs and the transverse plate 10 with the above mentioned devices on it, and the other one section including the back plate 18. The separate sections can be folded to a flat position to permit easy storage of the device. The support may be collapsible, demountable or foldable in order to minimize volume of the system when not in use. Preferably, the support is easy to assemble and prepare for use in order to minimize time wasted on assembling and mounting. This may for example be achieved by using spring-loaded elements which unfold themselves to the maximum size. The system should include as few separate parts as possible in order to minimize risk of incorrect assembly and to minimize assembly time. In other embodiments, the support can be a frame, stand, rack, tripod, etc. of suitable design.

Figure 3:
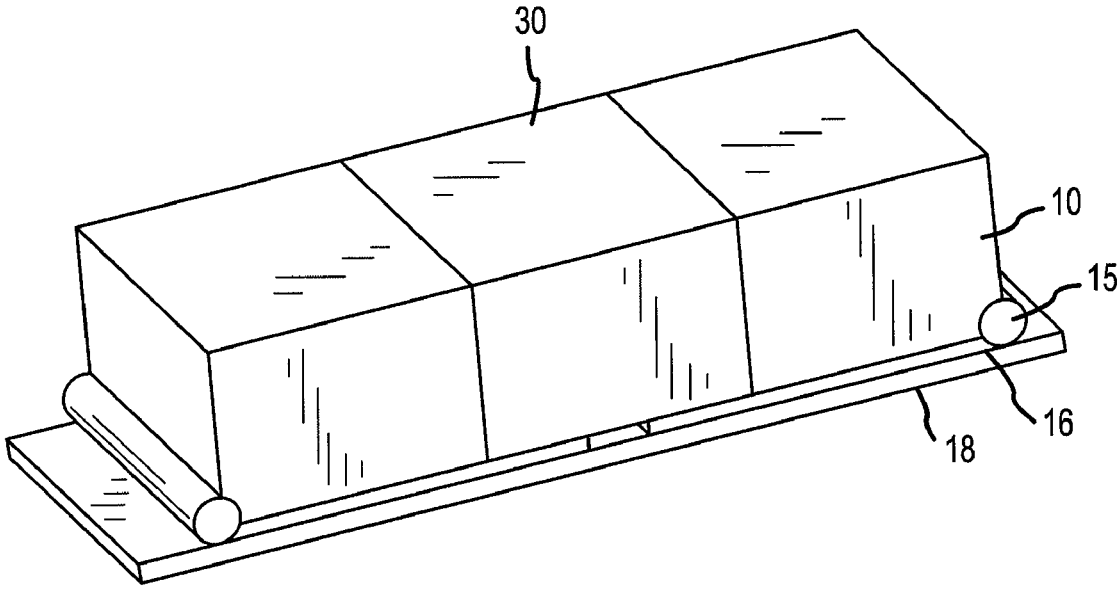
FIG. 3 is an isometric view of the embodiment of FIG. 2 in a folded state.

FIG. 3 is an isometric view of the embodiment of FIG. 2 in its folded state. In this embodiment, a lid 30 covers the batteries 13, signals processing device 4, motor 12 and other electronics, and is positioned on the transverse plate 10. The leg parts 16, 17 are folded under the base plate 10 by means of the hinges 15, and the folded upper section 16 rest on the back plate 18. This provides a very compact unit, which easily may be stored and transported.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A chest compression system, comprising:

a transverse plate spaced apart from a backing plate, the backing plate including a plurality of longitudinal slots;

at least two legs having an upper part hingeably coupled to the transverse plate and a lower part configured to slide in a respective one or more of the plurality of longitudinal slots of the backing plate;

a chest compression device mounted on the transverse plate and being structured to repeatedly compress the chest of a patient and thereafter cause or allow the chest to expand;

a signal processor mounted on the transverse plate, the signal processor being operable to control operation of the chest compression device; and a power supply device mounted on the transverse plate, the power supply device configured to provide electrical power to the chest compression device and the signal processor.

2. The chest compression system of claim 1, further comprising a measuring device connected to the signal processor and being operable to measure at least one characteristic of resuscitation provided by the chest compression device, the signal processor being operable to process input signals from the measuring devices.

3. The chest compression system of claim 2 wherein the measuring device comprises at least one of a force sensor and a depth sensor.

4. The chest compression system of claim 2 wherein the measuring device comprises a blood flow sensor.

5. The chest compression system of claim 2 wherein the measuring device comprises a ventilation sensor.

6. The chest compression system of claim 2, further comprising a data storing device connected to the measuring device, the data storage device being operable to store values indicative of the at least one characteristic of resuscitation measured by the measuring device.

7. The chest compression system of claim 1, further comprising a ventilation device.

8. The chest compression system of claim 1, further comprising a defibrillator device.

9. The chest compression system of claim 8, wherein the defibrillator device comprises an automatic external defibrillator (AED).

10. The chest compression system of claim 1, further comprising a user interface operable to provide information regarding the resuscitation.

11. The chest compression system of claim 1, wherein a distance between the transverse plate and the backing plate is adjustable.

12. The chest compression system of claim 11, wherein the distance between the transverse plate and the backing plate is adjustable by the upper part of each of the two legs having a smaller outer dimension than the lower part to allow the upper part of each leg to telescope inside of its respective lower part.

* * * * *